US006668593B2

(12) United States Patent
Okamoto

(10) Patent No.: US 6,668,593 B2
(45) Date of Patent: Dec. 30, 2003

(54) KNIT WEAR NECK PART KNITTING METHOD AND KNIT WEAR

(75) Inventor: Kazuyoshi Okamoto, Nara (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/203,936

(22) PCT Filed: Feb. 19, 2001

(86) PCT No.: PCT/JP01/01197

§ 371 (c)(1),
(2), (4) Date: Aug. 16, 2001

(87) PCT Pub. No.: WO01/63030

PCT Pub. Date: Aug. 30, 2001

(65) Prior Publication Data

US 2003/0019248 A1 Jan. 30, 2003

(30) Foreign Application Priority Data

Feb. 22, 2000 (JP) ..... 2000-43754

(51) Int. Cl.[7] ..... D04B 7/10
(52) U.S. Cl. ..... 66/64; 66/176
(58) Field of Search ..... 66/70, 176, 169 R, 66/69, 75.1, 64, 68, 189, 171, 170

(56) References Cited

U.S. PATENT DOCUMENTS 5,388,430 A * 2/1995 Essig ..... 66/64
5,417,088 A 5/1995 Nakai
5,943,884 A * 8/1999 Kobata et al. ..... 66/176
5,956,975 A 9/1999 Kawashima
6,286,340 B1 * 9/2001 Yui ..... 66/70

* cited by examiner

*Primary Examiner*—Danny Worrell
(74) *Attorney, Agent, or Firm*—Rothwell, Figg, Ernst & Manbeck, P.C.

(57) ABSTRACT

A knitwear (1) is knitted from its bottom hem to its shoulder, during which a flechage knitting that a body (2) is knitted so as to be forked into a right side and a left side of a neckline (10) and also the stitches around the neckline are sequentially removed from the knitting to be put into inoperative states is repeated a predetermined number of times, so as to form the neckline (10). Then, the knitting that stitches of the neckline (10) at right and left sides thereof including its oblique portions and its flat portions adjacent to the oblique portions are moved toward a center of the neckline, so that empty needles are provided in the oblique portions and also double stitches are formed in the flat portions. Then, the knitting that new stitches are formed at the empty needles in the next knitting of the collar (8) and also stitches of the next course are formed at the double stitches is provided for each of the right side of the neckline and the left side of the neckline (10), to thereby produce the collar (8) comfortable to wear and stylish having the drop having a sufficient length.

3 Claims, 11 Drawing Sheets

Fig. 3
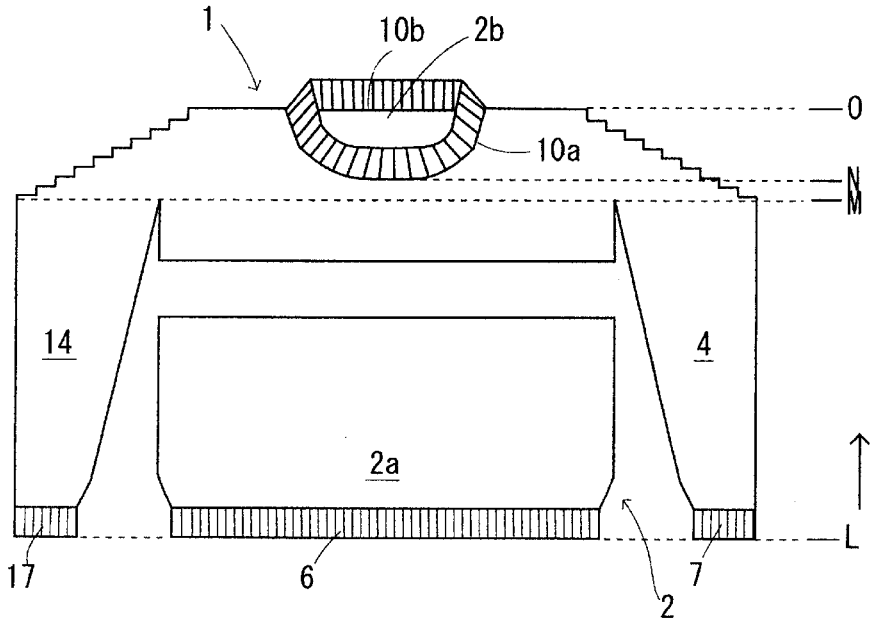
Fig. 4-A
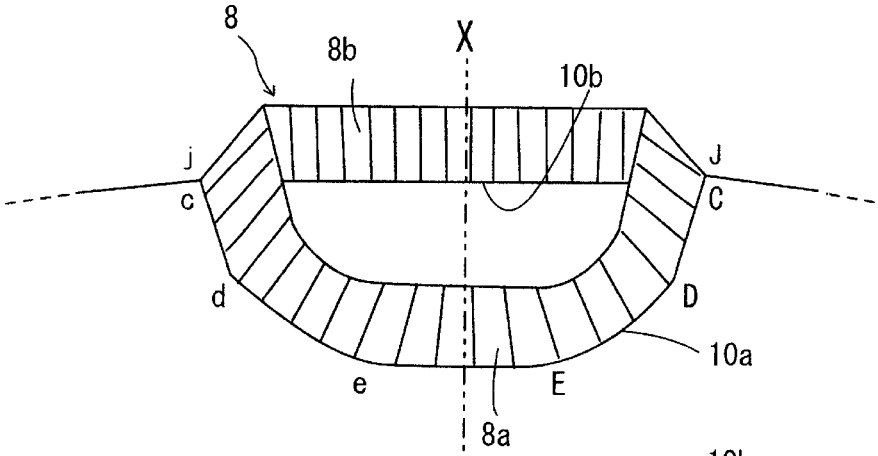
Fig. 4-B
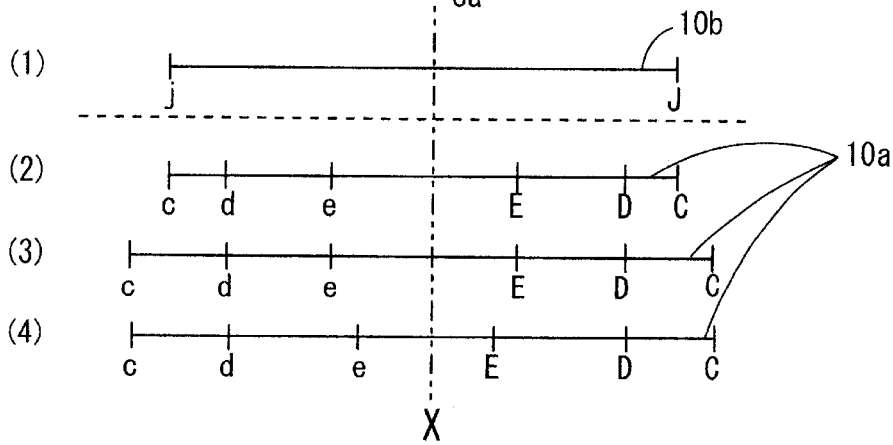

KNIT WEAR NECK PART KNITTING METHOD AND KNIT WEAR

TECHNICAL FIELD

The present invention relates to a knitting method for forming a neckline in knitwear, such as a vest and a sweater, knitted by using a flat knitting machine and to the knitwear knitted in the same knitting method.

BACKGROUND ART

In a conventional knitting method, when e.g. a vest is knitted by using a flat knitting machine, a neckline formed in the front body and a neckline in the back body are formed with the same number of needles. The neckline usually has an eguri called "a drop" which is formed in accordance with the shape of the neckline in wearing condition. The eguri formed in the front body is called "the front drop". Generally, the front drop is formed in such a process that when the front body is knitted, right and left sides of the neckline are knitted in the flechage knitting so as to form the eguri before forming a collar, followed by the forming of the collar. In this general process, the knitting width of the collar (number of wale) is not different than before forming the neckline in the flechage knitting and, as a result of this, the collar comes to be tight and accordingly the front drop does not have a sufficient depth.

The applicant of this application previously proposed in Japanese Laid-open (Unexamined) Patent Publication No. Hei 4(1992)-214448 a knitting method of knitting a knitted fabric by using a flat knitting machine wherein the neckline in the front body is widened and also the front drop is formed in the neckline. In this knitting method, the front body is so knitted as to be forked from a starting point for the neckline to be formed into a right front body and a left front body which confront each other across the neckline. In the process of the knitting, widening stitches are formed around the neckline and also the stitches at the right-hand side and left-hand side are shifted to the outside, respectively. This knitting process is repeated to knit the front body up to the shoulder portion. As a result of the neckline being formed in this manner, the number of wale of the neckline is increased and, as a result of this, not only the collar knitted subsequent thereto is widened but also the front drop is formed in the neckline. When the front body thus knitted is used to produce a sweater, the knitwear comes to be fancy and stylish and so comfortable to wear that when wearing, one's head can smoothly pass through the neckline.

Shown in FIG. 12 is the front body 101 forming therein the collar 100 comprising a flat portion X-Y and oblique portions W-X and Y-Z at both sides of the flat portion. The flat portion X-Y of the front collar 100 has the relationship of T1=T2 between the peripheral length (T2) of the flat portion X-Y and the number of wale (T1) of the flat portion X-Y. This indicates that the number of wale in the flat portion X-Y is well reserved for the peripheral length (T2) of the collar formed. On the other hand, the oblique portions W-X and Y-Z have the relationship of S1<S2, U1<U2 between the peripheral length (S2, U2) and the number of wale (S1, U1) of the oblique portions W-X and Y-Z, respectively. This indicates that the number of wale in the oblique portions W-X and Y-Z are not well reserved for the peripheral lengths of the collar formed. When the oblique portions W-X and Y-Z are short of the number of wale like this, the flat portion X-Y is transversely stretched out and raised up by the oblique portions W-X and Y-Z, so that the front drop is not so formed as to have a sufficient depth. As a result of this, the peripheral length of the actually knitted collar becomes S1+T1+U1 shorter than an anticipated peripheral length S2+T2+U2, so that a collar opening is not so formed as to have a sufficient diameter.

In the light of the drawback mentioned above, the present invention has been made. The present invention aims to disclose a knitting method of knitting knitwear having a drop formed to have a sufficient depth that is comfortable to wear and stylish, and knitwear having such a collar formed therein.

DISCLOSURE OF THE INVENTION

In order to accomplish the object mentioned above, the present invention provides a method of knitting a neck portion of knitwear comprising a front body, a back body and a collar of the front body and/or a collar the back body by using a flat knitting machine comprising at least a pair of front and back needle beds, at least either of which can be racked laterally to transfer stitches between the needles beds, wherein the knitwear is knitted from its bottom hem to its shoulder, during which a flechage knitting that the body is knitted so as to be forked into a right side and a left side from a starting point for the neckline to be formed and also the stitches around the neckline are sequentially removed from the knitting to be put into inoperative states is repeated a predetermined number of times, so as to form the neckline, followed by the forming of the collar around the neckline, the method comprising the step that the knitting that stitches of the neckline at right and left sides thereof including its oblique portions and its flat portions adjacent to the oblique portions are moved toward a center of the neckline, so that empty needles are provided in the oblique portions and also double stitches are formed in the flat portions and, thereafter, new stitches are formed at the empty needles in the next knitting of the collar and also stitches of the next course are formed at the double stitches is provided in each of the right side of the neckline and the left side of the neckline.

In the method of knitting the neck portion of knitwear, the knitwear knitted is a fabric whose front body and back body are knitted in layers in front and back into a tubular form and wherein the knitting that after the front body and the back body are joined together at the shoulder, the empty needles are provided in the oblique portions of the neckline and also the double stitches are formed in the flat portions and then the new stitches are formed at the empty needles in the next knitting of the collar and also the stitches of the next course are formed at the double stitches is provided in the neckline.

Further, in the method of knitting the neck portion of knitwear, it is preferable that while the stitches of the neckline retained on one of the needle beds are sequentially fed from the one located outside to an outside of the neckline retained on the opposite needle bed, the empty needles are provided therein to increase the number of wale of the neckline.

Also, the present invention provides knitwear, such as a vest or a sweater, wherein a neckline is so knitted as to be forked into a right side and a left side from a starting point for the neckline to be formed in the knitwear; a group of stitches in two adjacent regions at a boundary between a collar and the neckline are moved toward a center of the neckline to be close to each other; and the collar is formed continuously to new stitches formed in the space produced by the movement of the group of stitches and double stitches produced by the movement of the group of stitches.

According to the present invention, when a knitwear, such as a vest and a sweater, is knitted, a flechage knitting that for example the front body is knitted so as to be forked into a right front body and a left front body from a starting point for the neckline to be formed and also the stitches around the neckline are put into inoperative states from a center portion thereof to the outside, with the stitches retained by the needles, is repeated. As a result of this knitting, an increased number of courses are provided at the outside of the neckline, as compared with the number of knitting courses at the center portion of the neckline, and as a result of this, the neckline is formed into such a circular shape having a long depth at a center portion thereof and a short width at an outside thereof and also the right front body and the left front body are formed.

Sequentially, in order to supplement the number of wale to the peripheral length of the neckline, the following steps are taken. A group of stitches in the oblique portions and the flat portions are transferred to the opposed needle bed. Then, while the needle bed is racked toward the center of the neckline, the stitches as were transferred to the opposed needle bed are transferred back to the original needle bed. At this time, each time the racking pitch is increased in one pitch, two pitches, . . . , an adequate number of stitches are transferred back to the original needle bed. As a result of the stitches being transferred back to the original needle bed, while the needle bed is racked toward the center of the neckline, the empty needles are provided in the oblique portions of the neckline requiring the supplement of the number of wale and also the double stitches are formed by the stitches in the flat portions adjacent to the oblique portions being laid over each other.

Sequentially, the same knitting is symmetrically provided in the opposite side to said side across the center of the neckline, whereby the double stitches and the empty needles are provided in the same manner. As a result of this, the new stitches are formed at the empty needles provided in the oblique portions and thus the number of wale of the oblique portions is increased and also the stitches of the next course are formed at the double stitches in the flat portion and thus the number of wale of the flat portion is decreased. Thereafter, the yarn is fed to all regions of the neckline to form the collar.

It should be noted that when the fabric to be knitted is the fabric whose front body and back body are overlapped in layers in front and back and formed into a tubular form, the back body is knitted in parallel with the knitting of the front body and is joined to sleeves at its joining portion to the sleeves whenever the back body is knitted in the same manner as in the front body. After completion of the joining of the sleeves and the bodies, the front body and the back body are joined together at the shoulder. When the total number of wale of the neckline becomes shorter for the peripheral length of the neckline formed, for example the knitting to provide an increased number of wale of the front neckline is performed so that the stitches at the right side and left side of the neckline are shifted from inside to outside, with the gradually increasing distances of a stitch of distance, two stitches of distance, . . . from their respective preexistent positions, so as to insert the empty needles in between the adjacent stitches. When the empty needles are inserted in between the adjacent stitches, the stitches at each end of the front neckline should be fed to the outside of the stitch at each end of the back neckline formed in the back body, to feed the stitches between the first needle bed and the second needle bed, so as to prevent the difference between the number of stitches of the neckline retained by the needles of the first needle bed and the number of stitches of the neckline retained by the needles of the second needle bed from increasing two or more. As a result of the empty needles being inserted in between the adjacent stitches to increase the total number of wale of the neckline, for supplement, there is provided the result that the neckline having a large peripheral length can be knitted to ensure the formation of the front drop having a sufficient length.

BRIEF DESCRIPTION OF THE DRAWINGS

FIG. 3 shows the steps of the knitting of the sweater;

FIG. 4-a is an enlarged view of the collar of the sweater;

FIG. 4-b shows variation in peripheral length of a front collar and a back collar;

BEST MODE FOR CARRYING OUT THE INVENTION

In the following, a certain preferred embodiment of the present invention will be described with reference to the accompanying drawings. In the embodiment, a flat knitting machine is used which comprises a front bed (FB) and a back bed (BB), each having thereon a number of slide needles arranged in line and confronting each other in front and back, with the back bed being capable of being racked laterally, and a transfer jack bed (hereinafter it is referred to as "the TR jack bed") positioned over the front bed and having thereon a number of transfer jacks (hereinafter they are referred to as "the TR jacks") arranged in line at the same pitch as the needle pitch of the needle bed and provided so as to be racked laterally with respect to the needle bed so that stitches can be transferred therebetween, though not shown. In the embodiment, the flat knitting machine that can provide the specific knitting using a stitch holding technique which is called "the holding technique" disclosed by Japanese Laid-open (Unexamined) Patent Publication No. Hei 11(1999)-43849 can be used. The terminology, "holding", means the stitch holding technique using a compound needle, which is called "slide needle", comprising a needle body and a slider which is formed by combining two thin metal sheets and has a tongue at a front end portion thereof. In the holding technique, the stitch as was retained in the hook of the needle body is held by the needle and also an additional stitch is received and held on the tongue of the slider, so that those two different stitches are separately held by the same needle. Reference is made to the publication mentioned above for further details of "the holding". This holding technique enables the needle from which the stitch is transferred to be used as the empty needle temporarily. When this holding technique is used to transfer the held stitches back to the original empty needles after the knitting is adequately performed, even a two-bed, flat knitting machine can knit the knitwear seamlessly, without any limitation of using alternate needles for the transfer of stitches. The method of the embodiment can be applied to the knitting in which two fabrics knitted in layers in front and back are knitted into a tubular fabric as well as to the knitting in which only the front body is knitted as a part of the knitted fabric. In the following, illustration is given on the knitting provided in the process of knitting the tubular fabric into which the front and back bodies are continuously joined at each end thereof.

Figure 1:
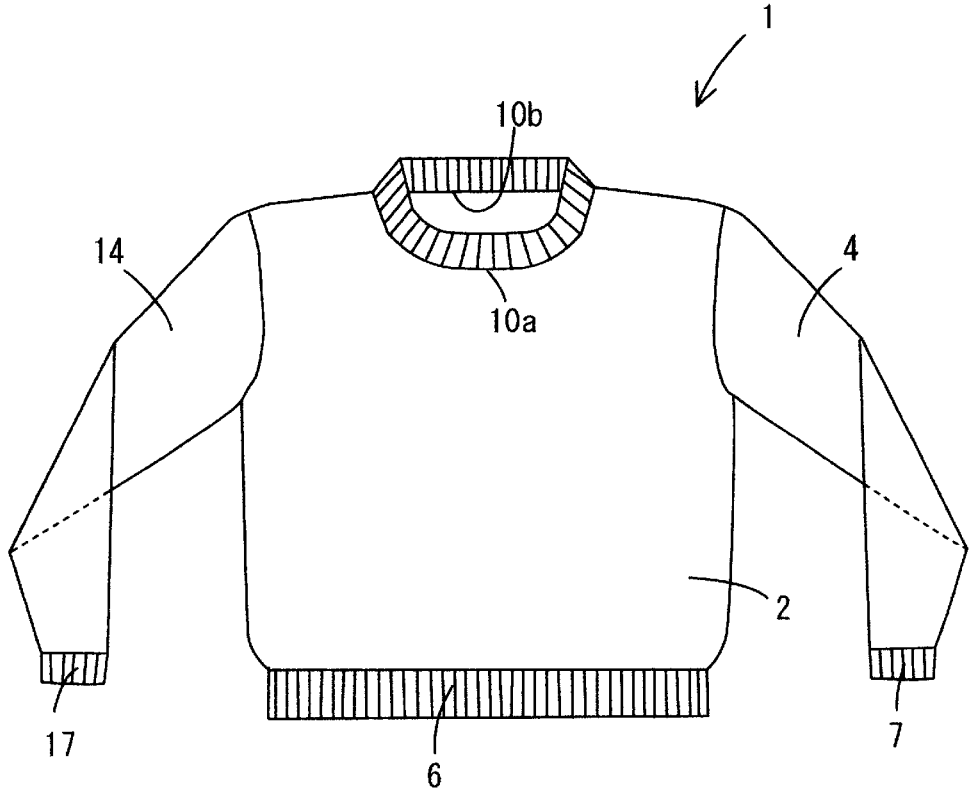
FIG. 1 shows a sweater having a collar knitted in the method of the present invention.
Figure 2:
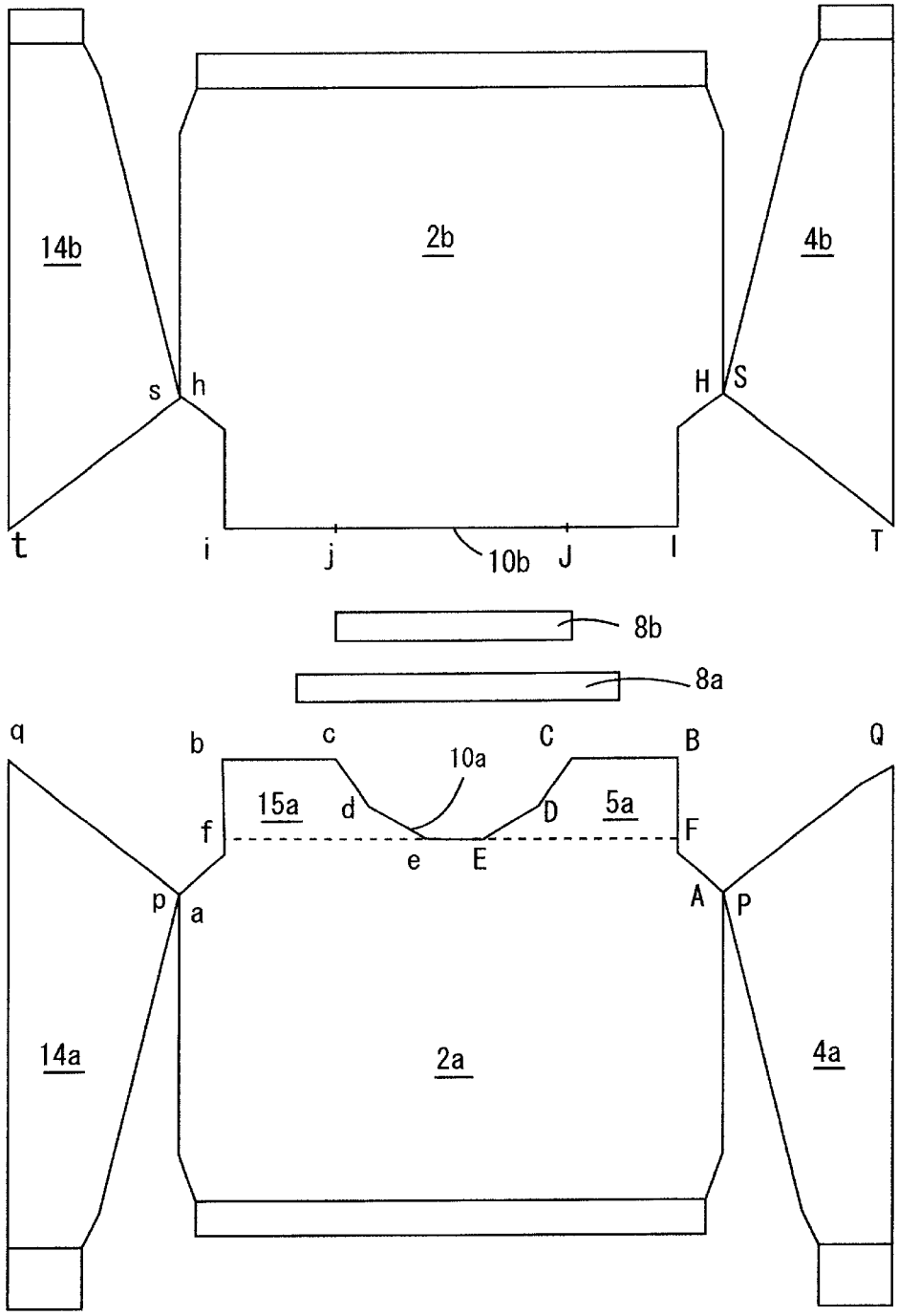
FIG. 2 is a development (pattern paper) of the sweater of FIG. 1.

FIG. 1 shows a sweater 1 knitted as knitwear in the embodiment. The sweater 1 has set-in sleeves and a rounded-neck having a U-shaped collar. For convenience of explanation, the sweater is designed in the form of a plain knit, though it may have another structure pattern such as jacquard or rib. FIG. 2 shows a pattern paper (stitch alignment) of bodies and sleeves of the sweater. Illustrated above is the pattern of a back body, right and left back sleeves, and a back collar 8*b*, which will appear at the back side when wearing the sweater. These parts are knitted with needles on the back bed. Illustrated below is the pattern of a front body, right and left front sleeves, and a front collar, which will appear at the front side when wearing the sweater. These parts are knitted with needles on the front bed, except a part of an outside portion of the front collar, as mentioned later.

In the sweater 1, the front body 2*a* and the front sleeves 4*a*, 14*a* are joined at the underarms A, a and P, p of the front body and the front sleeves, and the back body 2*b* and the back sleeves 4*b*, 14*b* are joined at the underarms H, h and S, s of the back body and the back sleeves. The line A-B of the front body 2*a* and the line P-Q of the sleeve 4*a* are joined together, and the line a-b of the front body 2*a* and the line p-q of the sleeve 14*a* are joined together. Likewise, the line H-I of the back body 2*b* and the line S-T of the sleeve 4*b* are joined together, and the line h-i of the back body 2*b* and the line s-t of the sleeve 14*b* are joined together. The front body 2*a* is different from the back body 2*b* in the shape subsequent to the points F, f of the neckline 10*a* and is knitted so as to be forked into the right front body 15*a* and the left front body 5*b*. It is to be noted that the terms "right" and "left" appearing in the members, such as the right front body 15*a* and the right sleeve 14, is intended to mean the right-hand part and the left-hand part when viewing from a wearer who wears the sweater. 8*a* designates a front collar having a width larger than the back collar 8*b*. The line C-D-E-e-d-c represents a neckline 10*a* of the front body 2*a* along which the front collar 8*a* is formed. The line J-j represents a back neckline 10*b* along which the back collar 8*b* is formed.

FIG. 3 shows an outline of the knitting of the sweater in the respective steps. In the step L, the knitting of the body 2 and the sleeves 4, 14 is started at tubular ribs 6, 7 and 17 by using yarn feeders (not shown) which are prepared for the body 2 and the sleeves 4, 14, respectively. Subsequently, each of the body 2 and the sleeves 4, 14 is knitted in the form of a tubular fabric until the step M. In the steps M to N, while the front body 2*a*, the back body 2*b*, the left sleeve 4 and the right sleeve 14 are knitted in the form of a single tubular body, they are joined together in each knitting. From the step N, an additional knitting is started wherein the front body 2 is separated into a left front body 5*a* and a right front body 15*a*, in the process of which a front neckline 10*a* is formed via the flechage knitting for knitting the left front body 5*a* and the right front body 15*a* and simultaneously the body and the sleeves are joined together along the lines A-B and P-Q, and a-b and p-q. This knitting goes on to the shoulder. During this knitting, the flechage knitting that the stitches around the margin of the neckline 10*a* extending along the line C-D-E-e-d-b are sequentially put into inoperative states is repeatedly performed, so as to form a circular cut. Sequentially, the line B-C of the front body 2*a* and the line I-J of the back body 2*b* and the line b-c of the front body 2*a* and the line i-j of the back body 2*b* are joined together at the shoulder portion, followed by binding off the stitches by known means to prevent the stitches from loosening.

Before entering into a detailed description of the actual knitting, the outline of the knitting will be explained with reference to FIG. 4. FIG. 4-a is an enlarged view of the collar of the sweater 1 and FIG. 4-b is schematic illustration of the variation in peripheral length of the front neckline 10*a* with respect to the back neckline 10*b*. The collar 8 has a front collar 8*a* formed around the front neckline 10*a* and a back collar 8*b* formed in the back neckline 10*b* of the back body 2*b*. The front neckline 10*a* comprises oblique portions of C-D-E and c-d-e extending obliquely and a flat portion of E-a. The right and left oblique portions each comprise an upper oblique portion C-D, c-d and a lower oblique portion D-E, d-e. The back neckline 10*b* is represented by (1) of FIG. 4-b, and the front neckline 10*a* is represented by (2) of the same drawing figure. The back neckline is equal in number of wale to the front neckline ((1)=(2)). In this state, the widening stitch knitting is provided in the upper oblique portions C-D, c-d, to increase the number of wale therein, so as to produce the state (3). As a result of this widening stitch knitting, the front neckline 10*a* becomes larger in peripheral length than the back neckline 10*b*. Then, after the stitches of the lower oblique portions D-E, d-e are moved toward a center line X—X, empty needles are inserted in the lower oblique portions, so as to allow adjacent stitches in the flat portion to be overlapped with each other. As a result of this knitting, the number of wale in the lower oblique portions D-E, d-e is increased, while on the other hand, the number of wale in the flat portion E-e is decreased, so as to produce the state (4). In this state, the peripheral length itself of the neckline is not varied from the state (3), but only the number of wale ratio between the lower oblique portions D-E, d-e and the flat portion E-e is varied.

Figure 5:
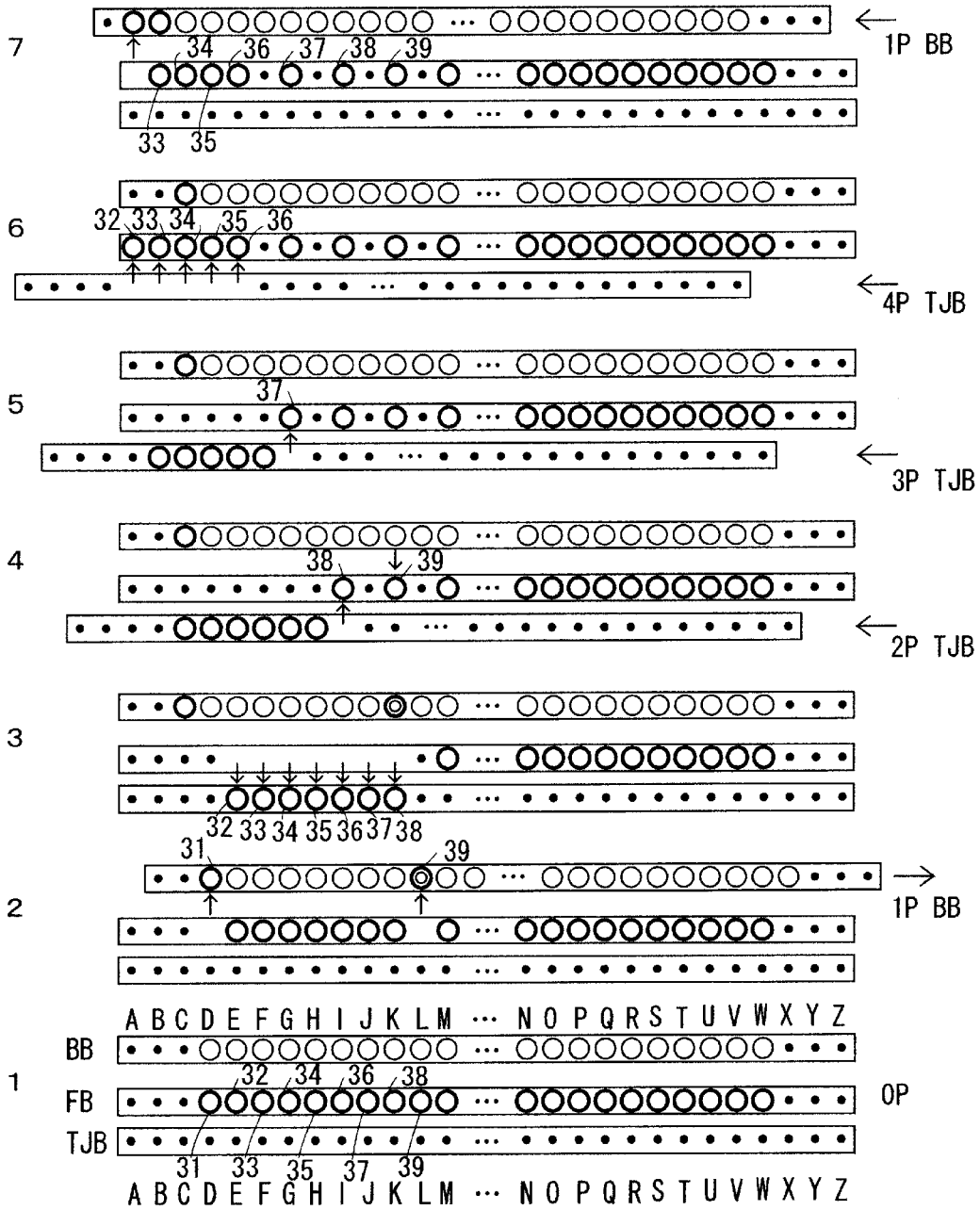
FIG. 5 is a knitting course diagram illustrating the knitting to extend the peripheral length of the front neckline.

Now, the widening stitch knitting to provide an increased number of wale in the upper oblique portions C-D, c-d of the neckline 10, so as to change from the state (2) to the state (3) of FIG. 4-b will be described with reference to FIGS. 5–7. The step 1 of FIG. 5 shows the state of the stitches being retained on the needle beds, which is presented when the knitting to join the sleeves and the bodies, except the neckline 10, is ended at the shoulder. The stitches of the front neckline 10*a* lying on the line C-D-E-e-d-c of the front body 2*a* are retained on the needles D-W of the front bed, and the stitches of the back neckline 10*b* lying on the line J-j of the back body 2*b* are retained on the needles D-W of the back needle bed. Bold circles in the diagrams represent the stitches of the front body 2*a*. The knitting needles A-M indicate the stitches on the left side of the center line X—X, and the knitting needles N-Z indicate the stitches on the right side of the center line X—X. In the actual knitting, the knitting is performed with a number of needles interposed between the needle M and the needle N. In the illustrated embodiment, four-wale increase in knitting width in each of the upper oblique portions C-D, c-d of the front neckline 10*a* is taken as an example.

The knitting for widening the neckline 10 is made by transference of the stitches of the front neckline 10*a*. During this knitting, the stitches of the back neckline 10*b* are held without transference. The steps 2–8 show the process of widening the left part of the neckline 10*a*, and the steps 9–15 show the process of widening the right part of the neckline 10*a*. The position where the back needle bed and the TR jack bed are in the positional relationship shown in the step 1 is taken as a starting point for the racking of the same beds. First, in the step 2, after the back bed is racked leftwards a stitch (1P), the stitch 39 retained on the needle D of the front bed is held on a tongue of a slider of a needle K of the back bed, the stitch 31 at the left end of the front neckline 10*a* retained by the needle D is transferred to the back needle bed.

In the next step 3, the stitches 32–38 retained on the needles E-K of the front bed are transferred to the TR jacks E-K. In the step 4, after the TR jack bed is racked leftwards two stitches (2P), the stitch 38 retained on the TR jack is transferred to the needle I of the front bed and also the stitch 39 held on the needle K of the back bed in the previous step 2 is transferred to the needle K of the front needle bed. In place of the holding technique used in the process previously mentioned, the transference of the stitch 39 may be afforded via the use of the TR jack.

In the step 5, after the TR jack bed is further racked leftwards one stitch of distance from the previous step 4, the stitch 37 retained on the TR jack I is transferred to the needle G of the front bed. In the step 6, after the TR jack bed is further racked leftwards one stitch of distance, the stitches 32–36 retained on the TR jacks E-I are transferred to the needles A-E of the front bed.

In the next step 7, after the back bed is racked leftwards one stitch of distance, the stitch 32 as was transferred to the needle A, of the front bed is transferred to the needle B of the back bed. The step 8 shows the state of the stitches of the neckline 10*a* being retained on the needle beds, which is presented when the back bed is returned to its starting racking point after the process of widening the left side of the neckline 10*a* is completed. The two stitches 31, 32 at the left end portion of the front neckline 10*a* are sequentially fed to the back bed from the stitch 31 situated at the end of the front neckline, so as to be situated next to the stitch at the side end of the back neckline 10*b*. The stitches 33–39 to be shifted at the left side of the front neckline 10*a* are shifted leftwards from inside to outside, with the gradually increasing distances of a stitch of distance, two stitches of distance, three stitches of distance and four stitches of distance from their respective preexistent positions. As a result of this, the four empty needles F, H, J and L are put into the state of being formed in the knitted fabric.

In the illustrated embodiment, the empty needles are inserted in between the stitches 36, 37, 38, 39, one in each space defined by the adjacent stitches. In the case where the neckline has a large number of stitches, the stitches may be shifted a stitch of distance, two stitches of distance, three stitches of distance and four stitches of distance every three stitches, for example, so that the empty needles may be inserted in the spaces thus formed, one in each of the spaces defined by those stitches. The empty needles required for the wale to be increased are inserted in between the stitches and the stitches required to be shifted are split from each other, to prevent the empty needles from being formed in a row. This enables the widening stitches to be smoothly formed in the later process. If the neckline does not have so many stitches to be split, then the empty needles may be formed in a row. In the illustrated embodiment, four wale are increased in each side of the front neckline from the center line X—X and then the stitches 31, 32 at the side end portion are fed to the back bed, to divide the difference in peripheral length between the front neckline and the back neckline, so as to prevent increase in difference between the number of stitches retained by the needles of the front bed and the number of stitches retained by the needles of the back bed, so as to avoid occurrence of yarn rupture and undesirable knitting lines. If two wale are increased in each side of the neckline, then only the stitch 31 at the side end thereof may be fed to the back bed. The number of stitches to be fed to the back bed depends on the number of wale to be increased in the neckline.

In the next steps 9–15, the same knitting as the widening knit in the steps 2–8 provided for the left side of the front neckline 10*a* from the center line X—X is provided for the right side of the neckline from the center line X—X. The step 15 shows the state of the stitches of the neckline being retained after the front neckline 10*a* is widened. The front neckline 10*a* is widened in knitting width, four wale at each side thereof, and two stitches at each end of the front neckline are fed to the outside of the back neckline 10*b* on the back bed. As a result of the stitches 31; 32, and 41; 42 at each side end portion of the front neckline 10*a* being fed to the back needle bed in this manner, the neckline can be increased in diameter, while keeping the stitches located at each side end portion of the front neckline in their retained state on the front and back needle beds, without being away from each other to a large extent. The step 16 shows the step of forming the widening stitches on the empty needles F, H, J, L, O, Q, S and U inserted in between the stitches when the collars 8*a*, 8*b* are knitted. The step 17 shows the step of feeding the yarn to the back neckline 10*b*.

Referring now to FIGS. 8–11, description will be given on the knitting steps from FIG. 4(3) to FIG. 4(4) wherein the stitches on the lower oblique portions D-E, d-e are shifted toward the flat portion E-e and also the empty needles are inserted in the lower oblique portions D-E, d-e, so as to increase the number of wale of the flat portion and decrease the number of wale of the flat portion E-e. Following on the knitting leading up to FIG. 7, the knitting of FIGS. 8–11 is provided. In FIGS. 8–11, for convenience of explanation, the knitting at the right side and the knitting at the left side of the center line X—X are illustrated separately. The marks (L) at the right-hand side of the step numbers indicate the knitting provided at the left side of the center line X—X of the neckline 10 (at the right side when viewed from the wearer), and the marks (R) at the left-hand side of the step numbers indicate the knitting provided at the right side of the center line X—X (at the left side when viewed from the wearer). In the step in which the knitting is provided only in either of the right side and the left side of the center line X—X, the knitting provided in the either side is illustrated. On the other hand, in the step in which the knitting is provided in both of the right side and the left side, the knitting provided in the right side and the knitting provided in the left side are separately illustrated, as shown in the step 13. In the numbered steps labeled (R) in FIGS. 8–11, the stitches of the upper oblique portion c-d of the front neckline 10*a* are retained at the left side of the front bed, and the stitches of right side of the center line X—X of the neckline 10 are retained at the right side of the front bed, though not shown. The stitches of the back neckline 10*b* and the stitches of the front neckline 10*a* transferred to the back bed are retained on the back bed. In the numbered steps labeled (L), the stitches of left side of the center line X—X of the neckline 10 are retained at the left side of the front bed, and the stitches of the upper oblique portion C-D of the front neckline 10*a* are retained at the right side of the front bed. The stitches of the back neckline 10*b* and the stitches of the front neckline 10*a* transferred to the back bed are retained on the back bed. In the following, illustration is given, taking as an example the case where the stitches of the lower oblique portions D-E, d-e at the right and left sides of the center line X—X are shifted to the flat portion E-e, so as to increase the four-wale in each of the lower oblique portions D-E, d-e.

Figure 6:
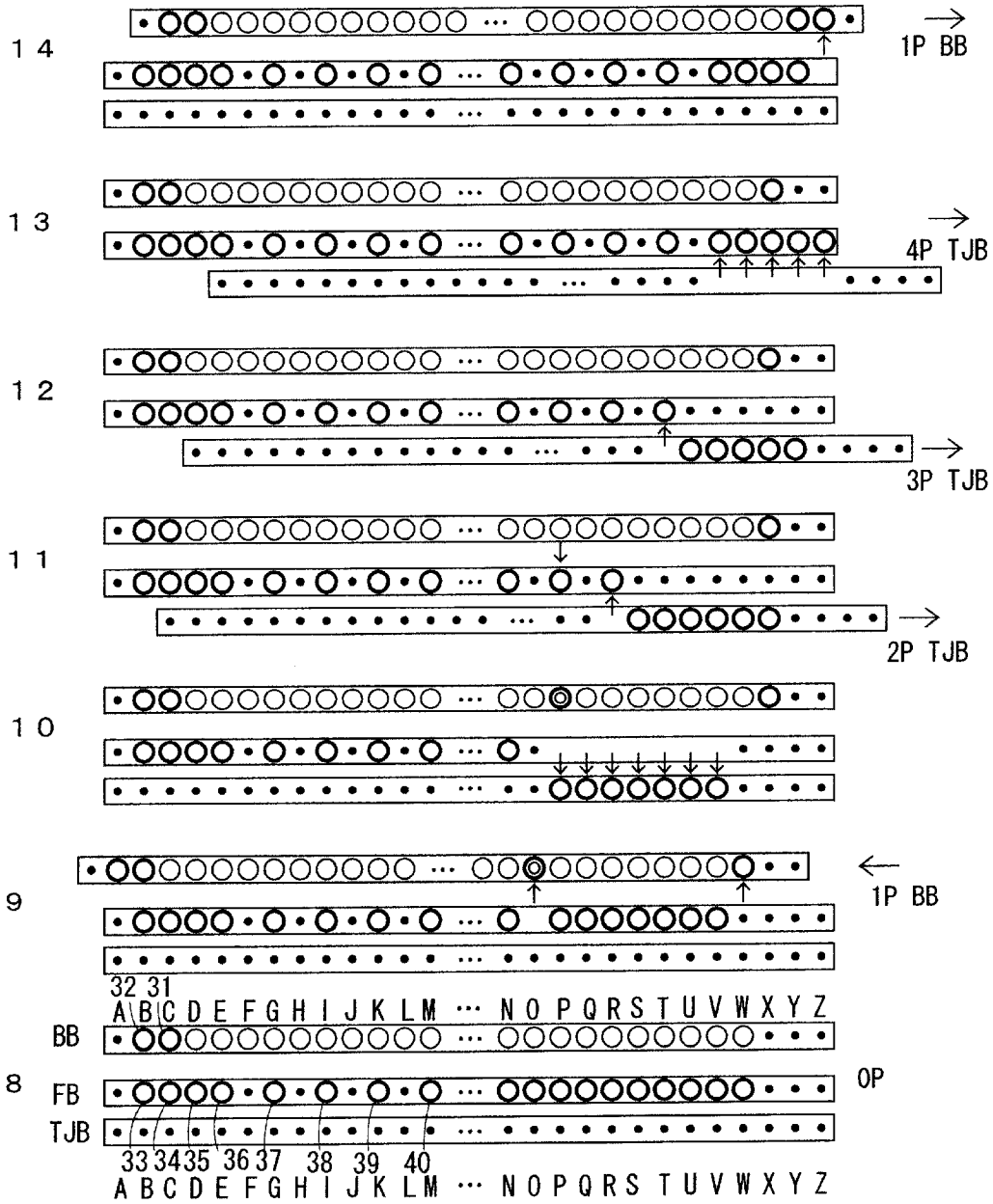
FIG. 6 is a knitting course diagram illustrating the knitting to extend the peripheral length of the front neckline.
Figure 7:
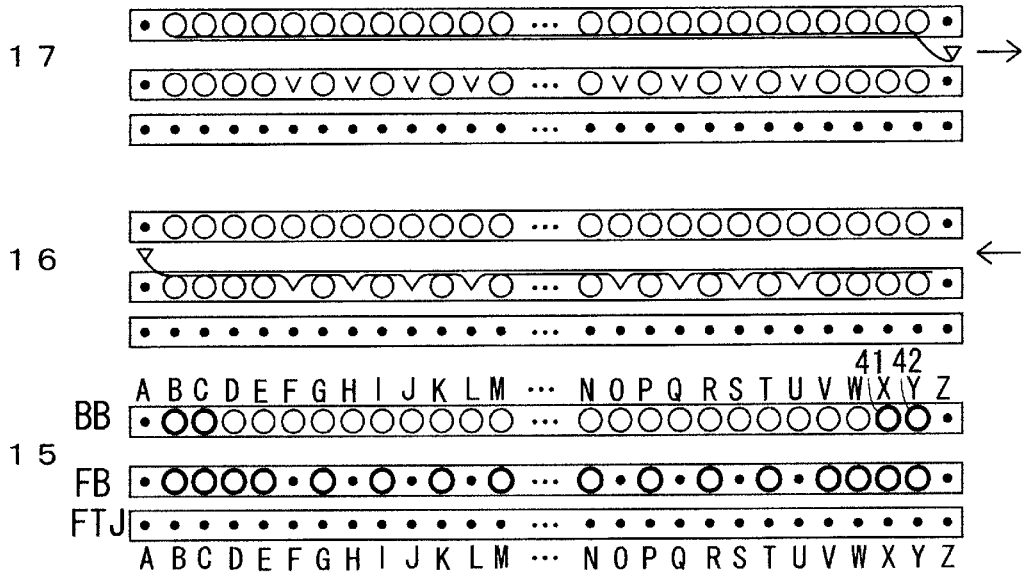
FIG. 7 is a knitting course diagram illustrating the knitting to extend the peripheral length of the front neckline.
Figure 8:
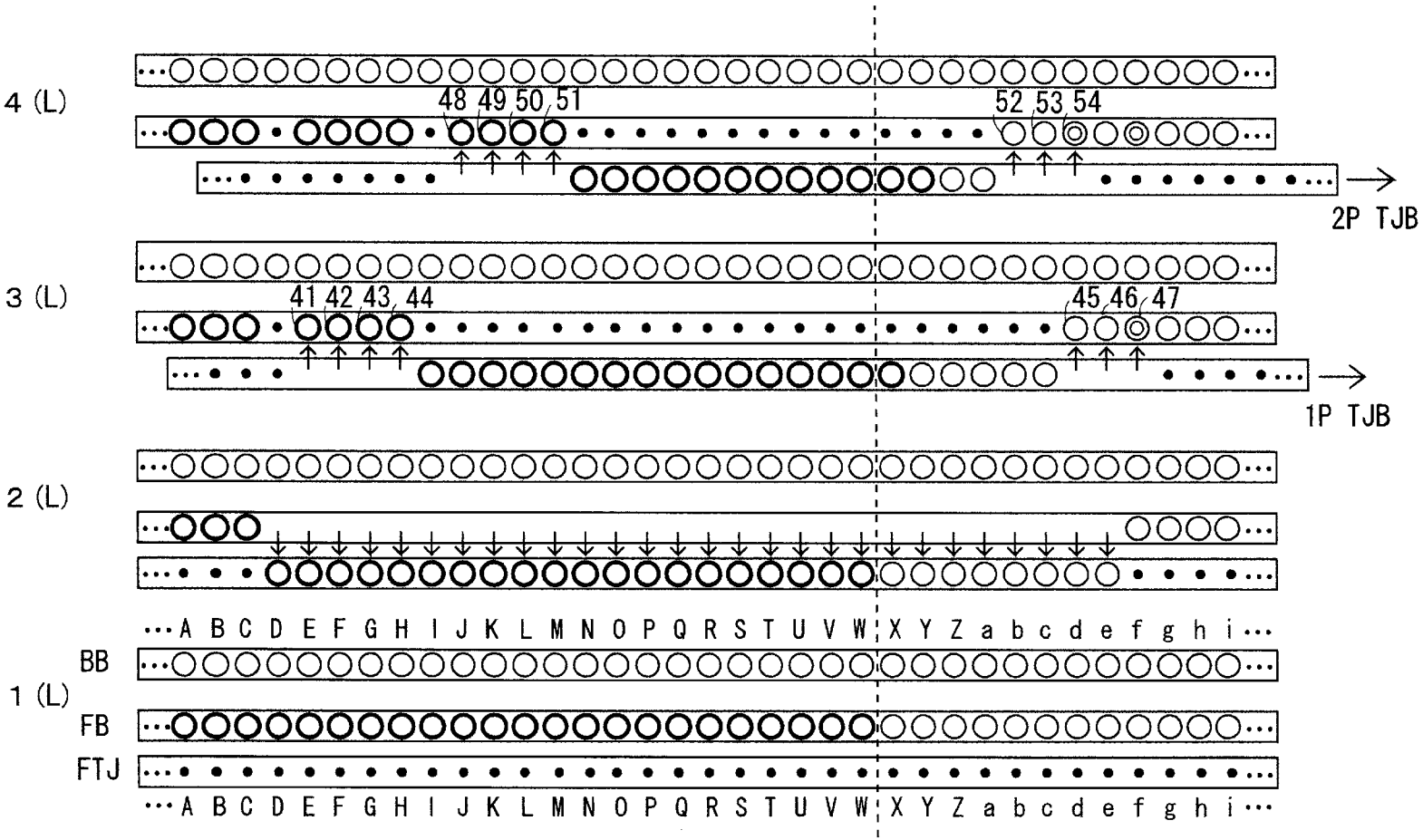
FIG. 8 is a knitting course diagram illustrating the knitting to change the ratio of the number of wale of the front neckline.
Figure 9:
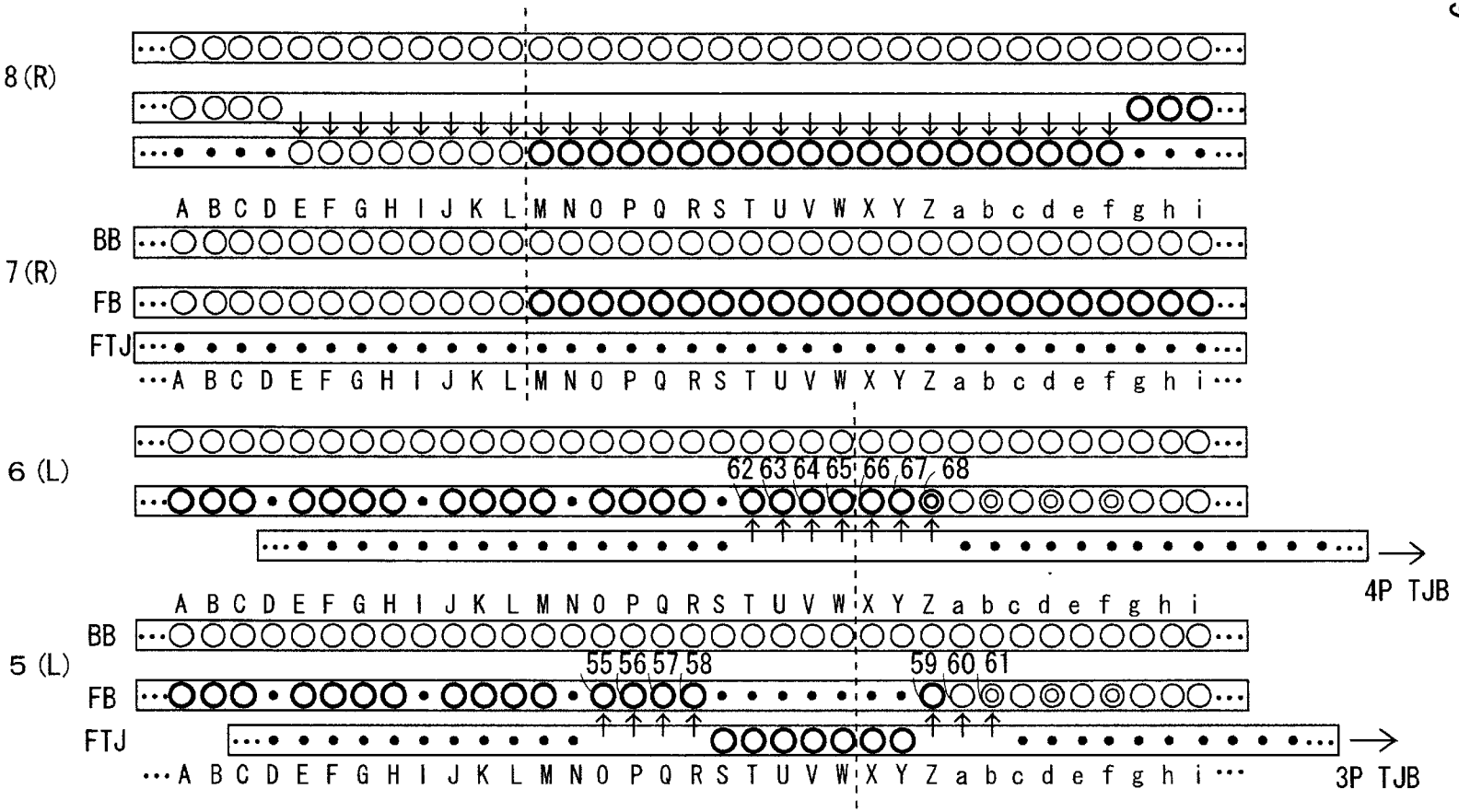
FIG. 9 is a knitting course diagram illustrating the knitting to change the ratio of the number of wale of the front neckline.
Figure 10:
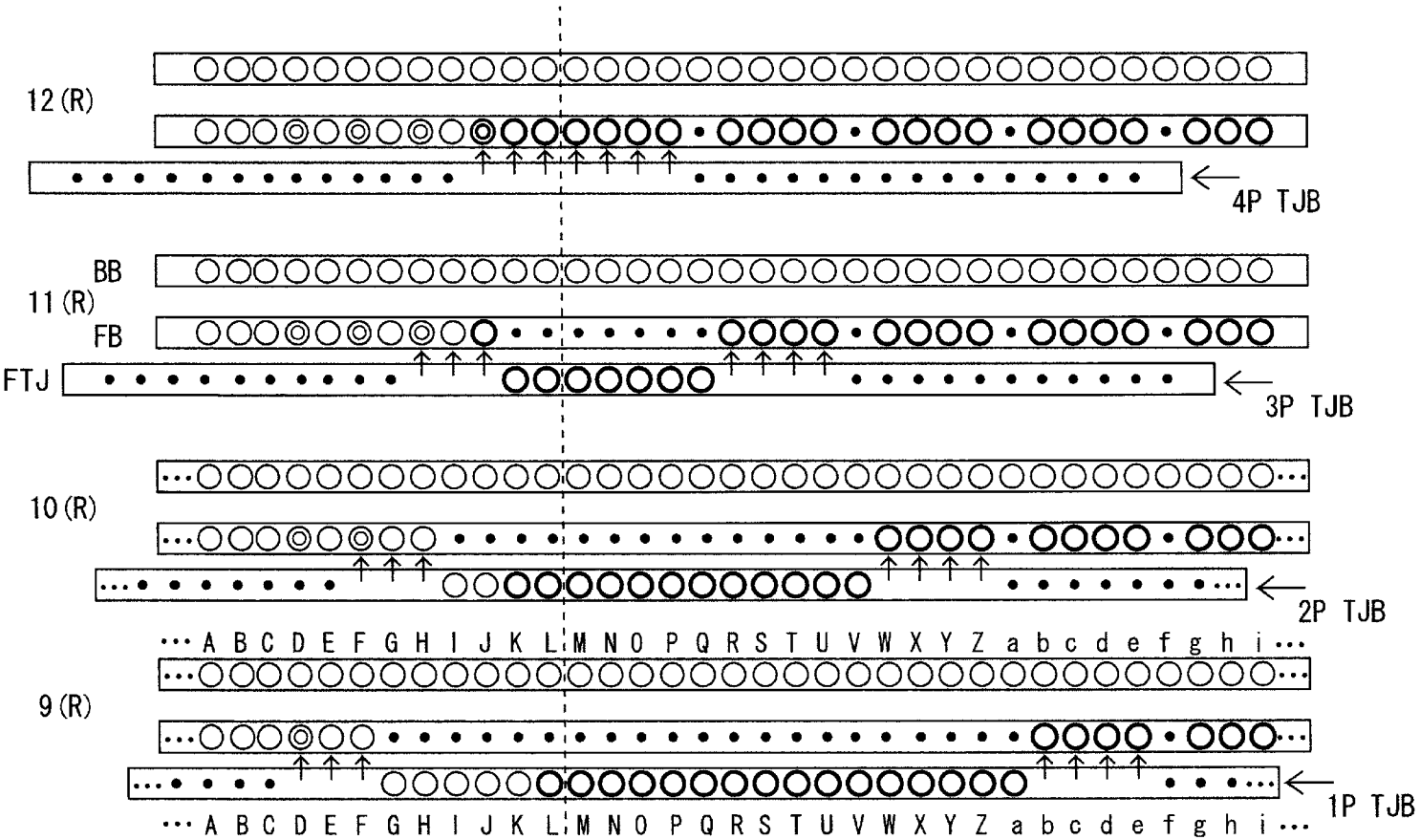
FIG. 10 is a knitting course diagram illustrating the knitting to change the ratio of the number of wale of the front neckline.
Figure 11:
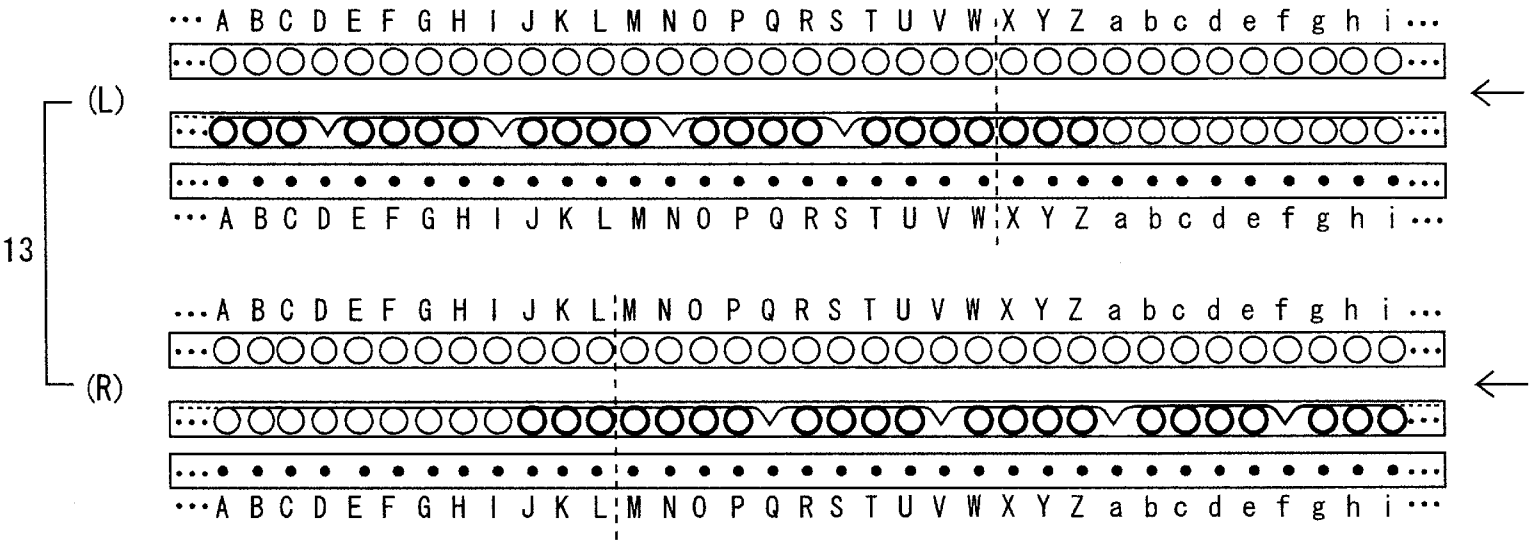
FIG. 11 is a knitting course diagram illustrating the knitting to change the ratio of the number of wale of the front neckline.
Figure 12:
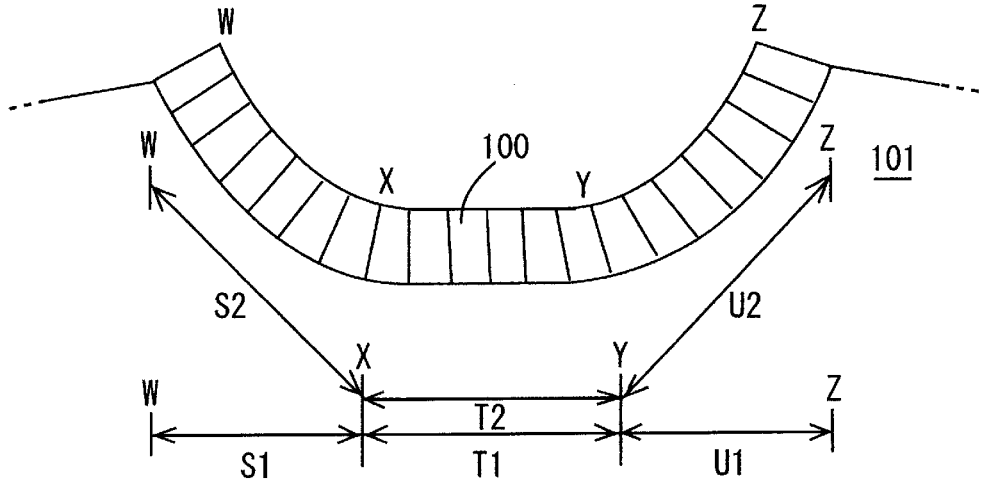
FIG. 12 is a diagram showing the relation between the peripheral length and the number of wale of the neckline formed in the conventional knitting method.

The step 1 of FIG. 8 shows the state of the stitches being retained on the respective beds, which is presented when the knitting of FIGS. 5–7 is completed. In the step 1, the stitches of the lower oblique portion d-e are retained on the needles A-W of the front bed; the stitches of the flat portion e-E are retained on the needles X-i of the front bed; and the stitches of J-j of the back neckline are retained on the needles A-i of the back bed. In the step 2, the stitches on the needles D-e of the front bed are transferred to the TR jack D-e of the TR jack bed. In the step 3, after the TR jack bed is racked rightwards one stitch of distance, the stitches 41–44 on the TR jacks D-G and the stitches 45–47 of the TR jacks c-e are transferred to the front bed. As a result of this, an empty needle is provided at the needle D of the front bed and also a double stitch is formed at the needle f. In the step 4, after the TR jack bed is further racked rightwards one stitch of distance from the state of the step 3, the stitches 48–51 on the TR jacks H-K and the stitches 52–54 on the TR jacks Z-b are transferred to the front bed, whereby an empty needle is provided at the needle I of the front bed and also a double stitch is formed at the needle d. In the step 5, after the TR jack bed is further racked rightwards one stitch of distance, the stitches 55–58 on the TR jacks L-O and the stitches 59–61 on the TR jacks W-Y are transferred to the front bed, whereby an empty needle is provided at the needle N of the front bed and also a double stitch is formed at the needle b. In the step 6 as well, after the TR jack bed is further racked rightwards one stitch of distance, the stitches 62–68 on the TR jacks P-V of the TR jack bed are transferred to the front bed, whereby an empty needle is provided at the needle S of the front bed and also a double stitch is formed at the needle Z. As a result of this, the empty needles D, I, N, S are provided in the lower oblique portions d-e of the front neckline 10*a* and the doubles stitches are formed at the needles Z, b, d, f.

From the step 7, the knitting goes on to the knitting at the right side of the center line X—X. In the step 7, the stitches of the flat portion e-E are retained on the needles A-L of the front bed; the stitches of the lower oblique portion E-D are retained on the needles M-i of the front bed; and the stitches of the lower oblique portion E-D of the back neckline 10*b* are retained on the needles A-i of the back bed. In the steps 7–12, the same knitting as the knitting in the steps 1–6 is performed symmetrically at the right side of the center line X—X, whereby double stitches are formed at the needles D, F, H, I of the flat portion e-E and also the empty needles are provided at the needles Q, V, a, f in the lower oblique portions E-D, as illustrated in the step 12. In the step 13(R), the yarn feeder is traveled rightwards from the right end to the left end of the front neckline 10*a*, so that new stitches are formed at the empty needles f, a, V, Q at the right side of the center line X—X and stitches of the next course are formed on the double stitches at the needles J, H, F, D. In the next step 13(L), stitches of the next course are formed on the double loops at the needles f, d, b, Z at the left side of the center line X—X and new stitches are formed at the empty needles S, N, I, D. As a result of the knitting in the steps 1–13 mentioned above, four wale is increased in each of the lower oblique portions D-E, d-e, and eight wale is decreased in total in the flat portion E-e at both sides of the center line X—X. In the knitting subsequent to the step 13, the yarn is cyclically fed to the front neckline 10*a* and the back neckline 10*b* to form the front neckline 8*a* and the back neckline 8*b* into a tubular form. Thereafter, the stitches of the final course of the collar are subjected to a known bind-off process for preventing loosening of stitches and the like process and then is slipped off from the needles. The knitting of the sweater 1 is ended with this.

In the knitting processes mentioned above, after the total number of wale of the neckline is increased in the knitting of FIGS. 5–7, the number of wale in the lower oblique portions D-E, d-e are increased and the number of wale in the flat portion E-e is decreased in the knitting of FIGS. 8–11, so as to supplement the number of wale in the lower oblique portions D-E, d-e. When the collar is knitted next to the neckline thus knitted, the collar can be formed into an intended shape to produce the knitwear with the collar comfortable to wear and stylish having the front drop having a sufficient length. While in the illustrated embodiment, the drop is formed in the front body 2*a* only, the drop can be formed in the back body 2*b* as well by providing the same knitting for the back neckline lob. While in the illustrated embodiment, the knitting of the FIGS. 5–7 that while the stitches situated at the outside of the front neckline 10*a* are fed to the back bed, the empty needles are provided in the front neckline 10*a*, so as to increase the total number of wale of the neckline 10 is provided for the upper oblique portions C-D, c-d only, this knitting may also be provided for the lower oblique portions D-E, d-e and the flat portion F-e.

The present invention is not limited to the illustrated embodiment. For example, even a general type of general-purpose two-bed flat knitting machine having no transfer jack or no slide needle can be used as the flat knitting machine used for the knitting of the present invention by using alternate needles, as previously mentioned. Likewise, the four-bed flat knitting machine may be used, in which the knitting of the present invention is afforded with every needle, without using the holding technique. Also, while in the illustrated embodiment, the widening stitch is formed by the yarn being hooked by the empty needle, the widening stitch may be formed in another method, such as a split knit.

Capabilities of Exploitation in Industry

According to the present invention, the front body and/or the back body of the collared knitwear is knitted from the hem to the shoulder, during which the flechage knitting that the front body is knitted so as to be forked into the right side and the left side from the starting point for the neckline to be formed and also the stitches around the neckline are sequentially removed from the knitting to be put into inoperative states is repeated a predetermined number of times, so as to form the neckline. Also, the neckline is so formed that the wale is supplied from the flat portion to the oblique portions for supplement, so that a ratio of the wale formed in the each portion of the collar is changed to a ratio suitable for an intended shape of the collar, followed by the knitting of the collar. This can produce the knitwear with the collar comfortable to wear and stylish having the drop having a sufficient length.

What is claimed is:

1. A method of knitting a neck portion of knitwear on a flat knitting machine, said knitwear comprising a front body, a back body and a collar of the front body and/or a collar of the back body said flat knitting machine comprising at least a pair of front and back needle beds, at least either of which can be racked laterally to transfer stitches between the needles beds, wherein the knitwear is knitted from a bottom hem of said knitwear to a shoulder of said knitwear, and the body is knitted with a flechage knitting a predetermined number of times to be forked into a right side and a left side from a starting point for a neckline to be formed and stitches around the neckline are sequentially removed during knitting to be put into inoperative states so as to form the neckline, followed by the forming of the collar around the neckline, the method comprising a step of, during knitting, moving stitches of the neckline at right and left sides including oblique portions and flat portions adjacent to the oblique portions of the neckline toward a center of the neckline, providing empty needles in the oblique portions and forming double stitches in the flat portions and, thereafter, forming new stitches at the empty needles in a next iteration of knitting the collar and forming a next course of stitches at the double stitches provided in each of the right side of the neckline and the left side of the neckline.

2. The method according to claim 1, wherein the step of providing the empty needles in the oblique portions of the neckline and forming the double stitches in the flat portions, and forming the new stitches at the empty needles and forming the next course of stitches at the double stitches, is performed after the front body and back body are knitted in layers in front and back into a tubular form and the front body and the back body are joined together at the shoulder.

3. The method according to claim 2, wherein while the stitches of the neckline retained on one of the needle beds are sequentially fed from one needle bed located outside of the neckline to an outside of the neckline retained on the opposite needle bed, the empty needles are provided therein to increase the number of wale of the neckline.

* * * * *